United States Patent [19]

Bochman, Jr.

[11] Patent Number: 4,924,734

[45] Date of Patent: May 15, 1990

[54] QUICK RELEASE AND EXCHANGE SOCKET DRIVE

[75] Inventor: Harry L. Bochman, Jr., Seal Beach, Calif.

[73] Assignee: Hi-Shear Corporation, Torrance, Calif.

[21] Appl. No.: 225,480

[22] Filed: Jul. 28, 1988

[51] Int. Cl.[5] ..... B25B 17/00

[52] U.S. Cl. ..... 81/57.12

[58] Field of Search ..... 81/57.12 O, 57.28, 57.29, 81/180.1, 177.85, 185, 124.3, 185.2

[56] References Cited

U.S. PATENT DOCUMENTS 1,352,461 9/1920 Lewhelt ..... 81/185.2

4,735,118 4/1988 Brogmel ..... 81/57.29

*Primary Examiner*—Frederick R. Schmidt

*Assistant Examiner*—Lawrence Cruz

*Attorney, Agent, or Firm*—Donald D. Mon

[57] ABSTRACT

A side-driven installation tool with a base plate in which a drive collar is rotatably fitted. A socket is drivingly fitted in the drive collar. The drive socket has an external peripheral groove. A retainer plate is slidably mounted to the base plate. In one position the retainer plate engages the drive socket in the groove to hold it in the drive collar. It can be shifted to a position away from the groove to enable the removal and replacement of the drive socket. A lock can be provided to hold the retainer plate in the engaged position.

3 Claims, 1 Drawing Sheet

QUICK RELEASE AND EXCHANGE SOCKET DRIVE

FIELD OF THE INVENTION

This invention relates to socket wrenches in which the socket is driven from one side of its axis, and in which ready exchange of the socket is desired.

BACKGROUND OF THE INVENTION

Side driven installation tools—such as power driven socket wrenches, often require that the socket size be changed rather frequently to drive fasteners of different sizes on the same job. A means is desirable to enable a quick and easy removal and replacement of the sockets. It is an object of this invention to provide a socket mount for that purpose.

BRIEF DESCRIPTION OF THE INVENTION

A quick release and exchange socket drive according to this invention has a base plate with a socket passage rotatably to receive a socket to be driven by power means such as an air motor to which the base plate is connected.

The base plate houses a rotatable drive collar into which the socket is fitted. Drive means interconnects the power means to the drive collar so as to drive it. The socket is fitted in the drive collar so as to rotate with it and be driven by it.

The socket includes a recessed peripheral groove to receive a retainer blade. The retainer blade is slidable, so that when it enters the groove it prevents the socket from moving axially and thereby locks it in place. When the blade is shifted out of the groove, the socket can be pulled out of the drive collar, and it can easily be replaced or exchanged.

Releasable lock means holds the retainer blade in its engaged position in the groove.

The above and other features of the invention will be fully understood from the following detailed description and the accompanying drawings, in which:

DETAILED DESCRIPTION OF THE INVENTION

Figure 1:
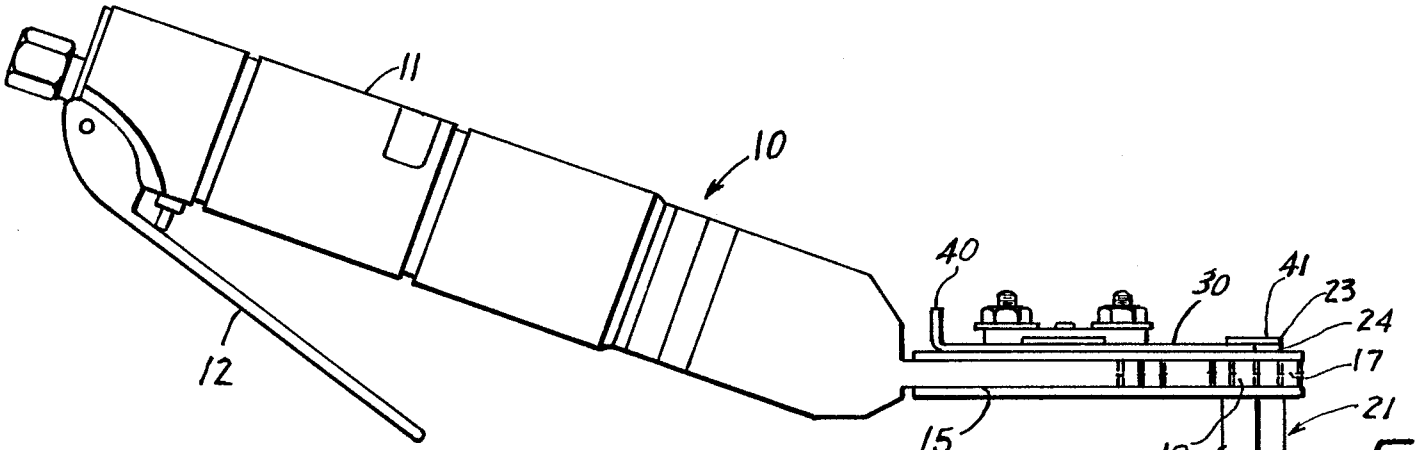
FIG. 1 is a side view of the presently-preferred embodiment of the invention.
Figure 2:
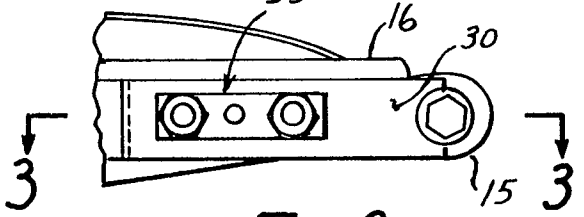
FIG. 2 is a fragmentary top view of FIG. 1.
Figure 4:
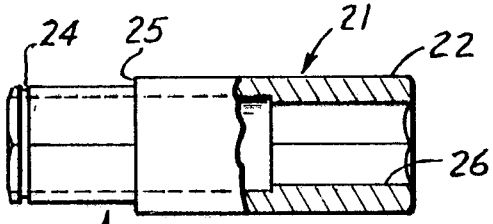
FIG. 4 is a side view, partly in axial cutaway cross-section, of the socket in FIG. 1.

FIG. 1 shows a hand-held installation tool 10 for offset driving of threaded fasteners. It is powered by driven means 11 such as an air motor, with a trigger 12 to control the power. The illustrated tool is a ratchet type which delivers successive reciprocations in the plane of a baseplate 15 to which it is attached. A drive rod 16 (FIG. 2) engages external teeth 17 on a drive collar 18 for the driving operation.

Drive collar 18 is rotatably fitted in the baase plate. It has an internal hexagonal array of surfaces (not shown) to receive and drivingly fit with an external hexagonal array 20 of surfaces on a drive socket 21. When installed, the drive socket projects beyond both ends of the drive collar. A cylindrical portion 22 projects below the base plate, and an upper portion 23 projects above it. A circular peripheral groove 24 is formed in the outer wall of the drive socket for locking purposes as will later be described. An external step 25 on the socket limits its uppermost movement. An internal array 26 of driving surfaces to engage or a fastener to be driven is formed.

A retainer plate 30 bears slidingly against the top of the base plate. It has one, or preferably a pair of slots 31, 32, which extend axially. A bridge plate 33 has two posts 34, 35, each of which fits in a respective one of the slots to hold the retainer pin in alignment. A lock hole 36 in the retainer plate is located where it will be engaged by a lock ball 37 when the retainer plate is in its most extended position where it holds the socket in place. A bias spring 38 biases the lock ball toward the retainer plate. This bias can be overcome by a sufficient sliding force exerted on the retainer plate. A flange 40 on the retainer plate is provided for the operator's convenience.

Figure 3:
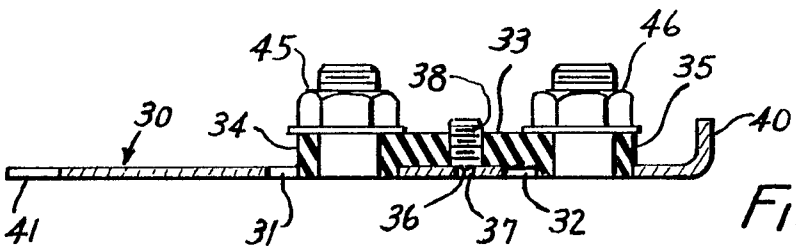
FIG. 3 is a partial cross-section taken at line 3—3 in FIG. 2.
Figure 5:
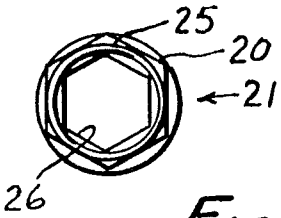
FIG. 5 is a left-hand view of FIG. 4.

A fork 41 on the end of the retainer plate has an internal curvature which enables the fork to fit into the groove so the drive socket is retained against removal when in the position of FIG. 3, and in which the drive socket is freely rotatable. Boltnut assemblies 45, 46 hold the bridge plate to the base plate.

The use of this apparatus should be evident from the foregoing. With the retainer plate in the position shown in FIGS. 1 and 3, the drive socket is drivingly retained in the drive collar. To remove it, the retainer plate is shifted to the right in FIG. 3 (to the left in FIG. 1), to remove the plates from the groove. The socket can then be pulled out of the drive collar, and later replaced or exchanged for another socket of the same or of a different size.

The bias of the lock can be overcome by a sufficient sliding force on the retainer plate. It reliably holds the drive socket in place until this force is exerted.

This invention is not to be limited by the embodiment shown in the drawings and described in the description, which is given by way of example and not of limitation, but only in accordance with the scope of the appended claims.

I claim:

1. A quick release socket drive, comprising:

a base plate having a passage;

a drive collar rotatably mounted in said passage, said drive collar being adapted to be driven by power means, and having a non-circular receptacle;

a socket drive having an external surface array geometrically similar to said receptacle to be removably fitted therein, and to be driven by said drive collar, an array of driving surfaces to engage a fastener to be set, and a peripheral groove;

a retainer plate slidably mounted to said base plate, having a fork at one end adapted to enter said groove in one position to retain the socket in the drive collar and thereby to the base plate, and to be shifted to another position free of said groove to enable the socket to be removed or inserted;

releasable lock means to hold said retainer plate in one position; and said retainer plate including a slot and in which a bridge plate incorporates two posts which engage in said slot to hold the retainer plate aligned, and in which said bridge plate supports a ball and bias spring which form part of said lock means, said bias spring biasing the ball against the retainer plate, said retainer plate having a hole to receive said ball when in said one position to hold the retainer plate in said one position.

2. A quick release socket drive, comprising:

a base plate having a passage;

a drive collar rotatably mounted in said passage, said drive collar being adapted to be driven by power means, and having a non-circular receptacle;

a socket having an external surface array geometrically similar to said receptacle to be removably fitted therein, and to be driven by said drive collar, an array of driving surfaces to engage a fastener to be set, and a peripheral groove;

a retainer plate slidably mounted to said base plate, having a fork at one adapted to enter said groove in one position to retain the socket in the drive collar and thereby to the base plate, and to be shifted to another position free of said groove to enable the socket to be removed or inserted from and into said drive collar;

releasable lock means to hold said retainer plate in one position; and said drive collar including an array of external teeth, reciprocable means being mounted to said base plate, engageable with said teeth, to drive said drive collar.

3. A socket drive according to claim 1 in which said drive collar includes an array of external teeth, and in which reciprocable means is mounted to said base plate, engageable with said teeth, to drive said drive collar.

* * * * *